US005184362A

United States Patent [19]

Yager et al.

[11] Patent Number: 5,184,362

[45] Date of Patent: Feb. 9, 1993

[54] PILLOW CASE WITH THREE DIMENSIONAL DESIGN

[75] Inventors: Pamela S. Yager, Farmington Hills; Nancy A. Pisha, Redford, both of Mich.

[73] Assignee: Saint Geeks, Inc., Farmington Hills, Mich.

[21] Appl. No.: 823,288

[22] Filed: Jan. 21, 1992

[51] Int. Cl.[5] ..... A47C 9/00

[52] U.S. Cl. ..... 5/490; 5/907; 446/72

[58] Field of Search ..... 5/636, 645, 482, 485, 5/490, 907; 446/72, 73, 74, 369; 428/16, 79

[56] References Cited

U.S. PATENT DOCUMENTS

| | | | |
|---|---|---|---|
| D. 163,982 | 5/1951 | Clark . | |
| D. 237,559 | 11/1975 | Johnston . | |
| 1,575,263 | 3/1926 | Guglielmi | 446/72 |
| 1,590,927 | 6/1926 | Duncan et al. | 446/72 |
| 1,703,629 | 2/1929 | Lange | 5/645 |
| 1,867,422 | 7/1932 | Shapiro . | |
| 2,630,574 | 3/1953 | Malarkey | 428/79 X |
| 3,608,092 | 9/1971 | Taranto | 428/79 X |
| 3,758,358 | 9/1973 | Kuroda | 428/79 X |
| 4,670,924 | 6/1987 | Spector . | |
| 4,763,369 | 8/1988 | Spector . | |
| 4,875,245 | 10/1989 | Isola . | |
| 4,889,512 | 12/1989 | Burnett et al. . | |
| 4,959,879 | 10/1990 | Marxhausen | 5/490 X |
| 4,968,279 | 11/1990 | Smith . | |
| 4,972,533 | 11/1990 | Brown . | |
| 5,027,457 | 7/1991 | Sweet . | |

*Primary Examiner*—Michael F. Trettel
*Attorney, Agent, or Firm*—Harness, Dickey & Pierce

[57] ABSTRACT

The appearance of a pillow case is changed to make the pillow case more aesthetically pleasing for a child's use. Preferably, this is accomplished by forming a pillow case from a first sheet and a second sheet comprised of cloth material. A three-dimensional figure, such as a front portion of a stuffed teddy bear, is then attached to the outside surface of the first sheet by sewn stitching. This creates a pillow case that is more pleasing for a child's use as a conventional pillow case, comforter, security object and plaything.

9 Claims, 1 Drawing Sheet

PILLOW CASE WITH THREE DIMENSIONAL DESIGN

BACKGROUND OF THE INVENTION

1. Technical Field

This invention relates generally to pillow cases, and more particularly, to a pillow case including a three-dimensional figure attached thereto to alter the aesthetic appearance of the pillow case.

2. Discussion

Conventional pillows and pillow cases are well known in the art. The conventional pillow and pillow case is generally rectangular in shape. The pillow serves as support for the head during rest and sleep, and is usually made of soft foam, feathers or other natural or synthetic material which provides for comfortable support for the head. The pillow case itself is usually made of cloth and serves as a cover for receiving the pillow, wherein the cover protects the pillow from becoming dirty and soiled, and may be removed from the pillow to allow for easy cleaning. Hence, when the pillow case becomes soiled, it is removed from the pillow and cleaned while the pillow remains substantially free from dirt.

The pillow case also serves a decorative and aesthetic function as well. For example, pillow cases come in a wide variety of colors, patterns and prints for use in any type of interior design or theme. This allows the pillow case to be changed to meet the particular aesthetic requirements while the pillow itself remains substantially unchanged.

Pillows and pillow cases also serve other functions as well. For example, as a comforter, security object and plaything for young children and toddlers. As such, a variety of decorative and dual-function pillows and pillow cases have been employed in the past to meet these additional functions. The following U.S. patents form a representative, though not exhaustive, list of various decorative and dual-function pillows and pillow cases: U.S. Pat. Nos. Des. 163,092 to W. L. M. Clark; Des. 237,559 to Johnston; 1,867,422 to C. Shapiro; 4,670,924 to Spector; 4,763,369 to Spector; 4,875,245 to Isda; 4,889,512 to Burnett et al; 4,959,879 to Marxhausen; 4,968,279 to Smith; 4,972,533 to Brown; and 5,027,457 to Sweet.

The current decorative and dual-function pillows serve a conventional use as a form of support for the head and also as home decorations and children's playthings. However, each of the current decorative and dual function pillows alter the overall shape of the conventional rectangular pillow by either adding additional parts to the pillow or by deforming the shape of the pillow itself. As such, these pillows become less useful and more uncomfortable in their conventional use as a support for the head and serve more in their secondary use as decorative items and playthings.

What is needed then is a pillow case which serves as a comfortable and useful conventional pillow case and also as an aesthetically pleasing pillow case, comforter, security object and plaything for a child. Thus, an object of the present invention is to provide such a pillow case.

SUMMARY OF THE INVENTION

In accordance with the present invention, a pillow case is formed from an envelope including a first sheet and a second sheet, wherein each sheet includes an inner surface and an outer surface. Each sheet is joined together such that the inner surface of each sheet defines a pillow cavity for receiving a pillow. A decorative three-dimensional figure is attached to the outer surface of the first sheet.

In the preferred embodiment, the first sheet and the second sheet are first joined together to form the pillow cavity for receiving the pillow. The periphery of a three-dimensional object such as a child's stuffed animal is cut to form a shell. The shell is stuffed and the shell and stuffing are attached to the first sheet by sewing the resulting three-dimensional stuffed figure to the outer surface of the first sheet.

Use of the present invention results in creating a pillow case that is comfortable and aesthetically pleasing for a child's use as a conventional pillow case, comforter, security object and plaything. As a result, the aforementioned problems associated with the prior decorative and dual function pillows should be substantially eliminated.

BRIEF DESCRIPTION OF THE DRAWINGS

Still other advantages of the present invention will become apparent to those skilled in the art after reading the following specifications and by reference to the drawings in which.

DETAILED DESCRIPTION OF THE PREFERRED EMBODIMENT

The following description of the preferred embodiment concerning pillow cases is merely exemplary in nature and is not intended to limit the invention or its application or uses.

Figure 1:
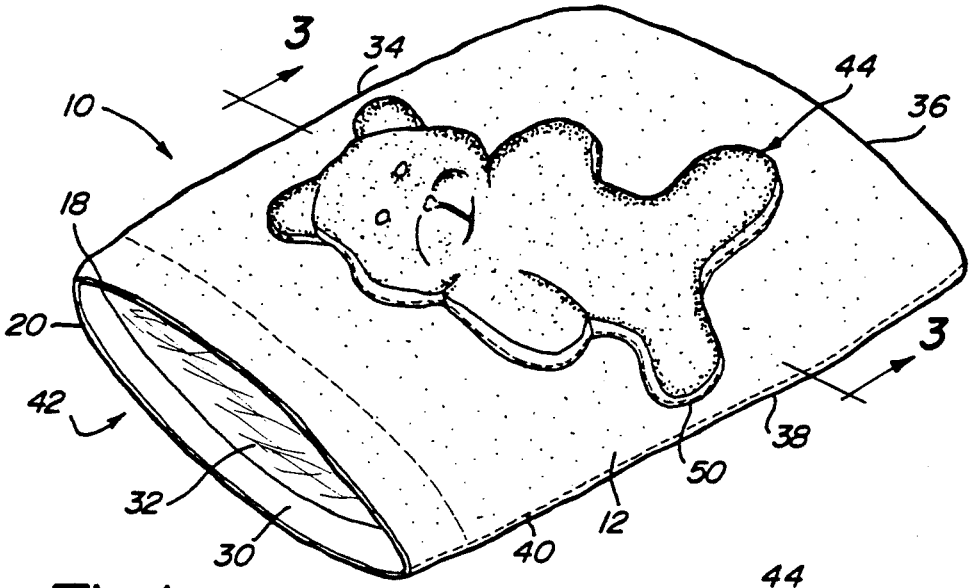
FIG. 1 is a perspective view of one preferred embodiment containing the three-dimensional figure.
Figure 3:
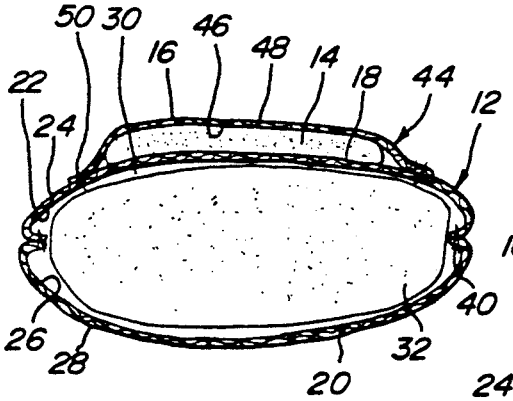
FIG. 3 is a cross-sectional side view of the embodiment of FIG. 1 taken along the line 3—3 of FIG. 1.
Figure 2:
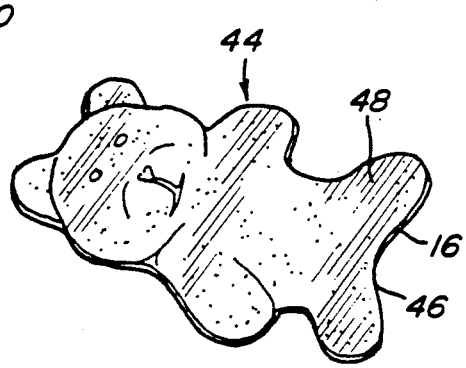
FIG. 2 is an exploded perspective view of the embodiment of FIG. 1 displaying the envelope, stuffing and shell.
Figure 2:
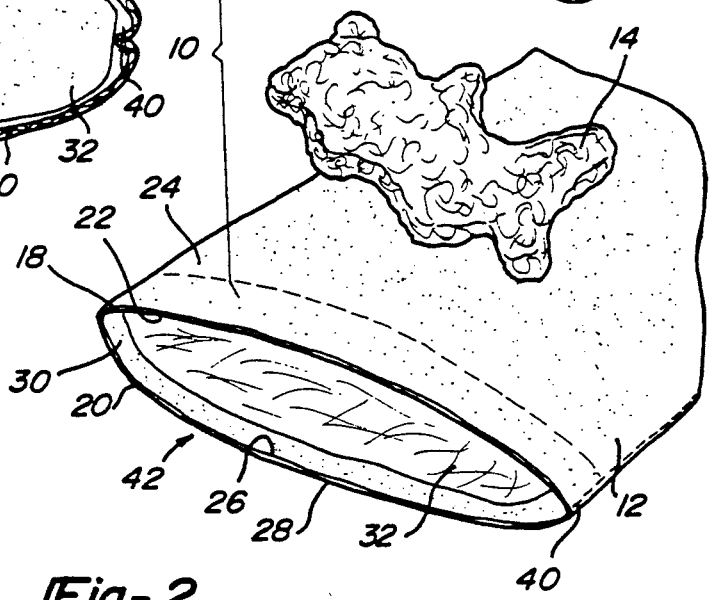

In FIGS. 1-3 there is shown a pillow case 10 that provides an aesthetically pleasing article for a child's use as both a conventional pillow case and also a plaything. As can be seen from FIG. 2, the pillow case 10 primarily includes an envelope 12, stuffing 14 and a shell 16.

Envelope 12, shown more clearly in FIG. 3, has a first sheet 18 and a second sheet 20. The first sheet 18 contains an inner surface 22 and an outer surface 24, while the second sheet 20 contains an inner surface 26 and an outer surface 28. The inner surface 22 of the first sheet 18 and inner surface 26 of the second sheet 20 defines a pillow cavity 30 for receiving a pillow 32. By way of a non-limiting example, the first sheet 18 and second sheet 20 are rectangular in shape and are approximately 30" long by approximately 18" wide. In addition, sheets 18 and 20 are made from cotton cloth which provides for easy care and washing. However, one skilled in the art will readily recognize that sheets 18 and 20 could be made in various shapes and sizes such as a square, triangle or circle and of various natural and synthetic types of materials and blends.

Turning to FIGS. 1 and 3, the first sheet 18 and second sheet 20 a- joined along their perimeters at sides 34, 36 and 38 by sewn stitches 40. This defines the pillow cavity 30 for receiving the pillow 32 through an opening 42. However, one skilled in the art will understand that the first sheet 18 and second sheet 20 can be made of a single piece of cloth folded along any of sides 34, 36 or 38 and joined at the two remaining sides by sewn stitches or other conventional joining means such that the pillow cavity 30 is formed for receiving the pillow 32 through opening 42. Furthermore, it is readily apparent that opening 42 may be closed by conventional closing means such as a zipper, buttons, snaps, etc.

Returning to FIG. 2, stuffing 14 is placed between the outer surface 24 of the first sheet 18 and shell 16 to create a three-dimensional FIG. 44 located atop sheet 18. Stuffing 14 is a polyester stuffing used to stuff conventional toy animals or characters. However, one skilled in the art will find it apparent that stuffing 14 can be any conventional natural or synthetic type of stuffing used to stuff toy animals or characters.

Shell 16 is created from a three-dimensional object (not shown) such as a toy stuffed animal, character or design. In the embodiment shown, the three-dimensional object is a child's teddy bear which is cut along its outermost periphery such that the front portion of the teddy bear containing the face and body forms shell 16. Shell 16 thus contains the three-dimensional contours of the front portion of the teddy bear, which includes a three-dimensional inner surface 46 and a three-dimensional outer surface 48. One skilled in the art would further understand that shell 16 could be created from any soft or plush three-dimensional stuffed animal, character or design.

Turning to FIG. 3, shell 16 is joined to outside surface 24 of first sheet 18 by sewn stitches 50 along the outermost perimeter of shell 16. However, one skilled in the art would understand that shell 16 can be joined to first sheet 18 by other conventional joining means and in any orientation relative to envelope 12 which may be desired. Stuffing 14 is positioned between the inner three-dimensional surface 46 of shell 16 and outer surface 24 of first sheet 18, such that stuffing 14 maintains the three-dimensional contours of shell 16. As such, stuffing 14 and shell 16 combine to create the three-dimensional FIG. 44 which changes the aesthetic appearance of envelope 12.

The foregoing discussions discloses and describes merely exemplary embodiments of the present invention. One skilled in the art will readily recognize from such discussions, and from the accompanying drawings and claims, that various changes, modifications and variations can be made without departing from the spirit and scope of the invention as defined in the following claims.

What is claimed is:

1. A decorative pillow case comprising:

an envelope, said envelope including a first sheet and a second sheet, said first sheet and said second sheet each including an inner surface and an outer surface, wherein the first sheet is joined to the second sheet to define a pillow cavity between the inner surface of the first sheet and the inner surface of the second sheet, said pillow cavity operable for receiving a pillow;

a three-dimensional figure wholly contained within the perimeter of one of said sheets, said three-dimensional figure includes a one piece soft three-dimensional shell of a soft three-dimensional plush figure, said shell having a three-dimensional inner surface and a soft three-dimensional plush outer surface; and stuffing, said stuffing operable to be located between the outer surface of the first sheet and the inner surface of the shell, wherein said stuffing maintains the soft three-dimensional plush outer surface contour of the shell, and wherein said shell is affixed to a portion of the outer surface of the first sheet by sewn stitches with the stuffing therebetween, wherein the three-dimensional figure decorates the envelope without substantially altering the overall shape of the envelope.

2. The decorative pillow case of claim 1 wherein the three-dimensional figure is a shell of a soft three-dimensional plush character and wherein the pillow case is designed for use by a child as a comforter, security object or the like, as well as a pillow case.

3. The decorative pillow case of claim 1 wherein the three-dimensional figure is a shell of a soft three-dimensional plush animal and wherein the pillow case is designed for use by a child as a comforter, security object or the like, as well as a pillow case.

4. The decorative pillow case of claim 3 wherein the shell of the soft three-dimensional plush animal is a shell of a teddy bear.

5. The decorative pillow case of claim 1 wherein the first sheet and the second sheet is a first piece of cloth and a second piece of cloth joined along their partial perimeter to define the pillow cavity.

6. The decorative pillow case of claim 5 wherein the first piece of cloth and the second piece of cloth are joined together along at least two sides by sewn stitches.

7. The decorative pillow case of claim 6 wherein the first piece of cloth and the second piece of cloth are in the shape of a rectangle.

8. An item that can be used both as a decorative child's pillow case and as a comforter, security object and the like, comprising:

an envelope, said envelope including a first rectangular sheet of cloth and a second rectangular sheet of cloth, said first sheet of cloth and said second sheet of cloth each including an inner surface and an outer surface, wherein the first sheet of cloth is joined to the second sheet of cloth along at least two sides by sewn stitches to define a pillow cavity between the inner surface of the first sheet of cloth and the inner cloth surface of the second sheet of cloth, said pillow cavity operable for receiving a conventional rectangular pillow;

a three-dimensional figure, said three-dimensional figure includes a one piece soft three-dimensional shell of a soft three-dimensional plush teddy bear, said shell having a three-dimensional inner surface and a soft three-dimensional plush outer surface; and stuffing, said stuffing operable to be located between the outer surface of the first sheet of cloth and the inner surface of the shell, wherein said stuffing maintains the soft three-dimensional plush outer surface contour of the shell, and wherein said shell is affixed to a portion of the outer surface of the first sheet of cloth by sewn stitches with the stuffing therebetween without substantially altering the overall shape of the envelope.

9. A method f forming a decorative pillow case, said method comprising the steps of:

providing a first sheet of cloth and a second sheet of cloth;

joining the first sheet of cloth and the second sheet of cloth along the partial perimeter of the first sheet of cloth and the second sheet of cloth to define a pillow cavity and an opening for receiving a pillow;

providing a soft three-dimensional stuffed figure;

cutting the periphery of the soft three-dimensional stuffed figure to form a soft three-dimensional shell;

stuffing the soft three-dimensional shell; and attaching the soft three-dimensional shell on an outer surface of the first sheet of cloth on and wholly within the perimeter of the outer surface with the stuffing therebetween with sewn stitching wherein the three dimensional figure decorates the envelope without substantially altering the overall shape of the envelope.

* * * * *